United States Patent [19]

Kamp

[11] Patent Number: 4,713,503

[45] Date of Patent: Dec. 15, 1987

[54] THREE PHASE VACUUM SWITCH OPERATING MECHANISM WITH ANTI-BOUNCE DEVICE FOR INTERRUPTER CONTACTS

[75] Inventor: Eugene L. Kamp, Fulton, Mo.

[73] Assignee: A. B. Chance Company, Centralia, Mo.

[21] Appl. No.: 900,538

[22] Filed: Aug. 26, 1986

[51] Int. Cl.[4] ..... H08H 33/66

[52] U.S. Cl. ..... 200/144 B; 200/153 G; 200/288

[58] Field of Search ..... 200/144 B, 153 G, 288

[56] References Cited

U.S. PATENT DOCUMENTS

| | | | |
|---|---|---|---|
| 3,129,308 | 4/1964 | Yokoyama et al. | 200/144 B |
| 3,163,735 | 12/1964 | Miller | 200/144 B |
| 3,180,960 | 4/1965 | Barkan et al. | 200/288 |
| 3,196,231 | 7/1965 | Meyer | 200/288 |
| 3,872,273 | 3/1975 | Netzel | 200/153 G |
| 4,099,039 | 7/1978 | Barkan | 200/144 B |
| 4,295,024 | 10/1981 | Kamp | 200/153 G |
| 4,484,046 | 11/1984 | Neuhouser | 200/144 B |

OTHER PUBLICATIONS

P. Barkan, "A Study of the Contact Bounce Phenomenon" in *IEEE Transactions on Power Apparatus and Systems*, vol. PAS-86, No. 2, Feb. 1967, pp. 231-240.

P. Barkan, Chapter 11.4.3, "Contact Bounce", in *Physics & Engineering of High Power Switching Devices*, by T. H. Lee, pp. 496-503.

*Primary Examiner*—Robert S. Macon

*Attorney, Agent, or Firm*—Schmidt, Johnson, Hovey & Williams

[57] ABSTRACT

The velocity of a snap action, spring loaded vacumm switch closing mechanism is substantially reduced by impacting a lever of the mechanism against a first swingable energy absorbing arm which, in turn, pivots to contact a pair of second energy absorbing arms. The pair of second arms are lightweight relative to the first arm and swing through a greater arc than the latter to permit oscillations to subside in remaining components of the switch before rebounding against the first arm. The swingable arms absorb a significant portion of the kinetic energy of the mechanism during closing of the contacts so that shock waves which are normally experienced in various components of the mechanism cannot combine to a value sufficient to snap the mechanism to an open circuit orientation. The anti-bounce device is particularly useful for three phase switchgear wherein a single, common mechanism functions to simultaneously close three pairs of electrical contacts. The closing mechanism has a latching member which cooperates with a latching pin to release the mechanism and close the switch when desired.

10 Claims, 9 Drawing Figures

26
130
3.
160
114
80
160
82
150
117
106
150
128
30
110
90
84
78
96
84
100
100
98
4.
94
4.
126
102
86
158
120
132
32
140
138
108
138
122
124
124
122
146
156
146
144
136
68
134
68
66
70
66
70
72
74
74
72
76
76
70
70
44
28
58
58
50
50
52
52
48
3.

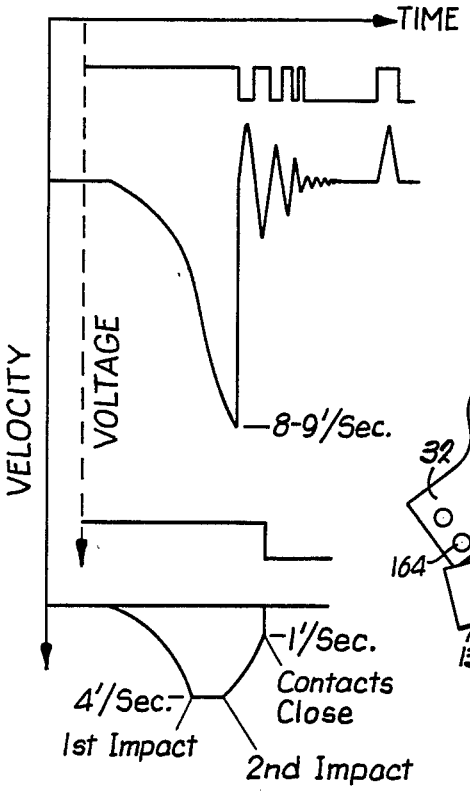
Fig.9.
Fig.3.
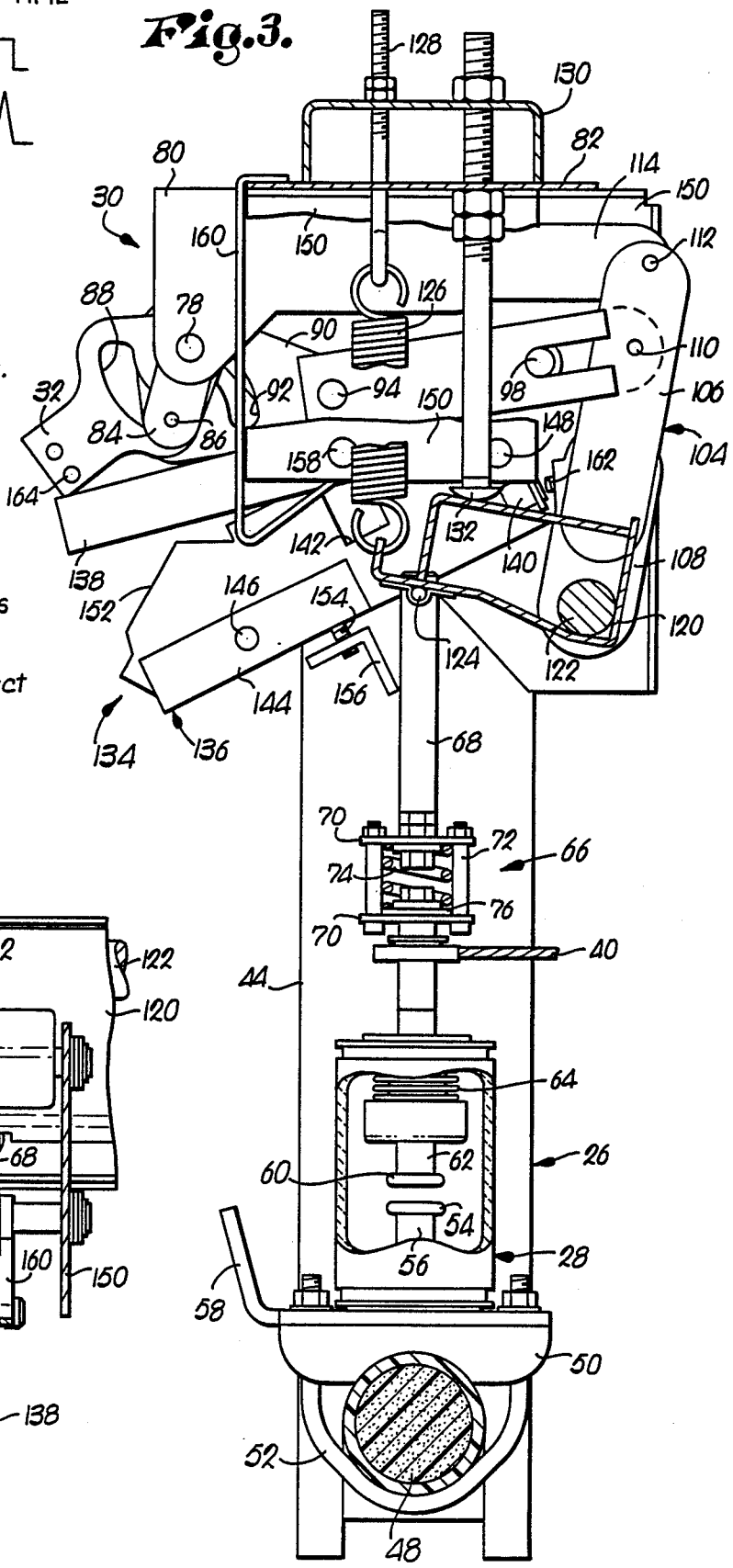
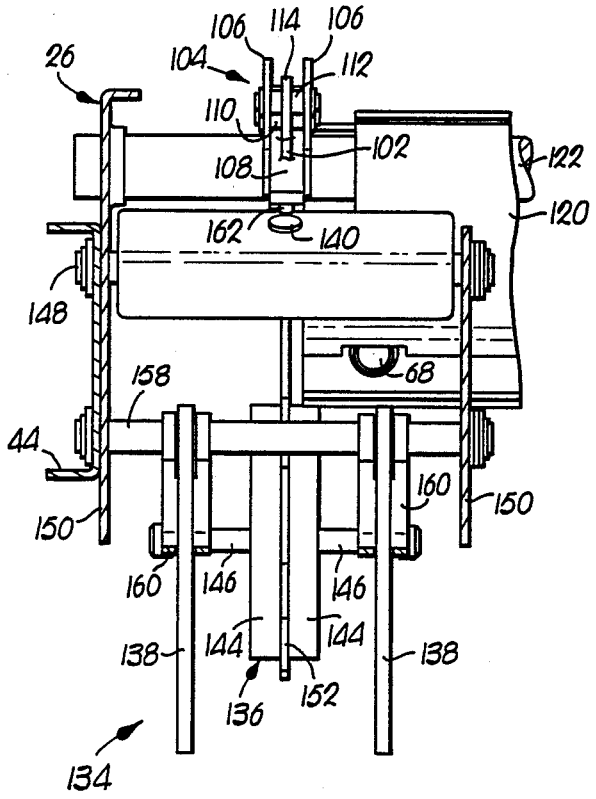
Fig.4.

THREE PHASE VACUUM SWITCH OPERATING MECHANISM WITH ANTI-BOUNCE DEVICE FOR INTERRUPTER CONTACTS

BACKGROUND OF THE INVENTION

1. Field of the Invention

This invention relates to a vacuum switch having a spring loaded mechanism for closing a pair of electrical contacts, wherein swingable arms are provided for absorbing a portion of the kinetic energy of the mechanism during closing of the contacts so that deformation of shafts supporting the contacts is avoided and the tendency of the contacts to bounce is suppressed. Preferably, a first energy-absorbing arm which is initially engaged by the operating mechanism to reduce the velocity of a movable contact supporting shaft swings to impact a pair of second energy-absorbing arms which function to absorb kinetic energy from the first arm so that subsequent rebound of the latter with the operating mechanism occurs with a reduced impact force and tendency of the contacts to separate as a result of the rebounding impact is correspondingly minimized.

2. Description of the Prior Art

Vacuum interrupter switches are widely used in the power distribution industry for isolating electrical circuitry downstream of the switches for maintenance, repair, or other servicing operations. Vacuum switchgear normally includes a plurality of vacuum bottles each of which encloses a pair of separable contacts, and one of the contacts is mounted on a stationary shaft while the other contact is mounted on a shaft which is shiftable to move the associated contact toward and away from a circuit closing position in engagement with the stationary contact. The vacuum within the bottle minimizes arcing of the contacts when the latter are spaced a small distance apart. Additionally, it is common practice to immerse the vacuum bottle in a quantity of dielectric oil for transferring heat produced by electrical current through the switch away from the vacuum bottle and to enable the bottles to be located in close proximity to fuse structures.

Three phase switchgear normally includes three pairs of separable switch contacts that are enclosed within respective, side-by-side vacuum bottles mounted on a common support. In devices of this type, a single operating mechanism is often used to shift all of the movable contacts simultaneously and to ensure that all phases of the circuit are energized or de-energized at identical times. The switching mechanism may include a toggle member that is swingable to an over center position to enable tension springs to thereafter shift the movable shafts and the contacts supported thereby toward a position of engagement with respective stationary contacts with a motion that is positive and relatively fast.

In the past, it has been observed that the snap action toggle mechanism often used to quickly and positively close high voltage electrical contacts occasionally damages the switch by deforming the relatively soft copper contact-supporting shafts and essentially shortening the length of the same whereby the operating characteristics of the switch are drastically altered. In order to overcome any undesirable change in the operating characteristics of the switch, the shafts are sometimes work hardened by subjecting the switch to numerous opening and closing operations and thereafter the operating mechanism is readjusted for proper switch operation prior to shipping thereof. As can be appreciated, such a procedure is costly and also imposes undesirable frictional wear on the switch before the same is placed into actual use.

In order to overcome the problem of contact shaft deformation, U.S. Pat. No. 4,295,024, which is owned by the assignee of the present invention, describes the use of a switch closing mechanism which has a swingable energy absorbing member that absorbs a high proportion of the impact force developed during the switch closing sequence which would otherwise be transferred to the contact shafts. In brief, the energy absorber of U.S. Pat. No. 4,295,024 is pivotally mounted in a location proximal to the switch closing apparatus such that an engagement surface on the swingable member is disposed in the path of the closing apparatus during closing of the switch contacts so that a certain portion of the kinetic energy of the closing mechanism is transferred to the energy absorber in order to slow the velocity of the movable contact shaft immediately prior to closing and thereafter permit a relatively soft impact between the contacts.

Special considerations exist when a single spring loaded toggle mechanism is used to simultaneously move contact shafts of three vacuum bottle assemblies of a three phase distribution switch. For example, a wipe spring mechanism is often associated with each movable contact shaft to allow some degree of overlap between the mechanism and the contact shaft of each bottle and to compensate for minor differences in the distance each contact shaft must move to firmly seat the contacts together with equal pressure. Each wipe spring mechanism includes a spring interposed between a contact supporting shaft and an insulating rod or shaft that is connected to the closing mechanism, so that flexure of individual springs when the switch is closed compensates for contact erosion and biases all contact pairs together with a substantially equal force.

However, each of the three vacuum bottles in three phase switches are normally carried by a common mounting rod that is secured on opposite ends to the switch cabinet and which is comprised of an electrically insulative material. Mounting rods of this type are somewhat flexible and readily absorb a portion of the closing energy transmitted to the vacuum bottles by the spring loaded mechanism; however, the rods will later transfer a significant portion of the kinetic energy initially absorbed back to the vacuum bottles during subsequent oscillations. Moreover, the stiffness of the rod or resistance to lateral deflection varies along the length of the latter in accordance with the distance to rod support structure, so that, in effect, the spring constant for the bottle mounting means is somewhat different from bottle to bottle. Furthermore, it is to be remembered that the spring closing mechanism is a dynamic structure which invariably oscillates after switch closing due to kinetic energy that is imparted back to the mechanism from impact of the switch contacts, and which also oscillates because of reaction forces generated by the closing springs between members of the mechanism itself.

The phenomena of contact bounce arises when the kinetic energy of the movable contact and its associated shaft is not sufficiently dissipated during a switch closing operation. More particularly, when a movable contact collides with a stationary contact, the contacts will not remain permanently in mutual engagement without some measure of dissipation of the kinetic energy because it is not possible to find a common velocity for the contact interface which simultaneously satisfies the laws of conservation of energy and momentum. A portion of energy dissipation at the contact interface occurs by the above-mentioned deformation of the contact shafts although it is more desirable to transmit the energy into the supporting structure by means of stress waves for ultimate dissipation or storage in components remote from the contacts.

The problem of contact bounce becomes more apparent when it is realized that spring-loaded, snap action switch mechanisms of this type usually are converted into a substantially rigid body once the switch is closed, which facilitates transfer of shock waves through the mechanism by reducing the number of remote sites where oscillations can occur and eventially subside. Moreover, the closing force produced by the springs of the mechanism is relatively large, and may be approximately 500 pounds or more, in order to sufficiently provide momentum to a somewhat hefty member or beam which is often connected to all of the contact shafts for simultaneous closing thereof and also in order to overcome the total bias presented by the wipe springs of all three bottles. As such, relatively large impact forces are generated during switch closing and must be sufficiently dissipated in order to overcome the problem of contact bounce.

In U.S. Pat. No. 4,484,046, the closing mechanism of a vacuum load break switch is provided with a dashpot type shock absorber which suppresses secondary energy oscillations that are produced by the closing mechanism after impact of the contacts; however, such a shock absorber generally only snubs the oscillating reactions and does not satisfactorily reduce contact shaft velocity to eliminate the initial bounce of the contacts upon impact.

SUMMARY OF THE INVENTION

The present invention overcomes the above noted problem by provision of an anti-bounce device for vacuum interrupter contacts which not only eliminates most shaft deformation but also which substantially precludes accidental reopening of the contacts due to shock oscillations within the system subsequent to switch closing. The anti-bounce device includes swingable energy absorbers which temporarily retain a significant quantity of the reaction forces produced during contact closing and store the energy for a period of time sufficient to enable oscillations in other components of the system to dissipate, thereby reliably preventing the contacts from inadvertently reopening.

One of the problems which has been overcome during development of the present invention is the tendency of energy absorbers which are disposed in the path of the closing mechanism to initially swing away from the same after contact therewith, and subsequently rebound and swing toward a position of reengagement with the closing mechanism to thereby transfer a portion of the kinetic energy back to the mechanism and the associated movable contact shafts. In occasional instances, the swingable energy absorber can rebound and engage the closing mechanism at the same time that the latter is experiencing a maximum stress oscillation in a direction urging the contact shafts toward an open position. That is to say, after initial switch closing and impact of the contacts, it is possible that the resultant stress oscillations occuring in the resilient mounting rod, the contacts, the contact wipe springs, the closing mechanism, the support structure for carrying the mechanism as well as other components within the cabinet happen to move simultaneously in the same direction and combine to form a resultant energy wave at a particular instant that, when combined with a rebounding impact of the swingable energy absorber, is sufficient to snap the switch mechanism to an open position.

Additionally, the nature of the closing mechanism is such that only a small amount of clearance is available for the swinging movement of the energy absorber and thus the latter likely will rapidly rebound a number of times against the closing mechanism subsequent to the initial encounter of the same with the energy absorber. The present invention, however, minimizes the probability that any of the rebounding impacts will cause the contacts to snap open, a problem that is otherwise particularly troublesome when the switch is inadvertently closed into a fault since contact bounce under fault conditions can weld or seriously erode the contacts.

More particularly, my anti-bounce device comprises a first arm which is pivotally mounted for free swinging movement and which is located in the path of a spring loaded switch closing mechanism as the latter moves a contact supporting shaft toward the closed circuit position. Initial impact of the closing mechanism against the swingable arm transfers a portion of the kinetic energy of the closing mechanism to the arm and reduces the velocity of the contact shaft by a factor of approximately one-half.

The anti-bounce device further includes a second arm means which comprises two spaced arms that are lighter in weight relative to the first arm and which are swingable independently of the same. The two, relatively lightweight arms are disposed in the path of swinging movement of the first arm, so that both of the second arms absorb a portion of the kinetic energy of the first arm to prevent the first arm from rebounding against the switch closing mechanism with sufficient energy for reopening the contacts.

During the switch closing operation, a hardened set screw mounted on a lever of the closing mechanism impacts against a hardened insert that is provided on the first arm, and the latter subsequently swings upwardly in a vertical plane until reaching a shaft which advantageously also pivotally carries the two second arms. Initial impact of the lever with the arm transfers a portion of the kinetic energy from the closing mechanism to the arm and reduces the velocity of the lever. Prior to rebound of the first arm against the shaft, however, the first arm contacts the two lightweight arms and causes the latter to also swing upwardly through an arc which is substantially greater than the arc of allowable movement of the first arm. As a consequence, the velocity of the first arm is reduced before impacting the shaft, and thus will rebound from the shaft at a correspondingly reduced velocity until the first arm then contacts the lever of the closing mechanism. At this time, however, the contacts have not yet engaged and the lever is simultaneously approaching the first arm so that engagement between the first arm and the lever further reduces the velocity of the contact shaft coupled to the lever to about ten to twenty percent of the initial velocity of the contact shaft. As a result, the contact supported by the movable shaft engages the stationary contact with a relatively soft impact force such that synchronized oscillations in the support structure, vacuum assemblies and closing mechanisms cannot, without more, reach an energy level sufficient to inadvertently reopen the switch.

In one experiment, it was observed that the closing springs of the spring loaded mechanism initially moved the contact shaft at a velocity of eight to nine feet per second. After initial engagement with the first arm, however, the resulting loss in kinetic energy of the switch closing mechanism reduced the velocity of the contact shaft to approximately four feet per second. Thereafter, after engagement of the first arm with the two lightweight arms and a corresponding surrender of kinetic energy to the latter, rebound of the first arm and subsequent contact with the lever of the closing mechanism further reduced the kinetic energy of the mechanism to a value wherein the velocity of the contact shaft was approximately one foot per second immediately prior to closing of the contacts. Eventually, the two lightweight arms return in a downward direction toward a position of reengagement with the first arm, but such reengagement occurs only after a sufficient amount of time has enabled the oscillations in other components of the system to subside.

Another aspect of the present invention involves a novel latch which enables the closing springs of the mechanism to be initially stretched by an operating handle and a pivotal element associated therewith and thereafter be readily released to quickly move the lever and contact shafts toward a closed circuit position. The latch simplifies construction over known closing mechanisms using a second toggle which operates in conjunction with a spring loaded toggle in an effort to provide latching of the mechanism in an open circuit position. The mechanism as disclosed herein advantageously is of a configuration to readily fit within the confines of the switch cabinet with a minimum of components.

BRIEF DESCRIPTION OF THE DRAWINGS

FIG. 3 is an enlarged side cross-sectional view of the closing mechanism, anti-bounce device and vacuum bottle assemblies taken along line 3—3 of FIG. 2, with parts broken away in section to better reveal the closing mechanism and electrical contacts within one of the vacuum bottles, wherein the mechanism and switch contacts shown in an open position at rest;

FIG. 4 is a fragmentary, enlarged, plan view of a lower portion of the closing mechanism and anti-bounce device shown in FIG. 3;

FIG. 9 represents velocity-time characterizing graphs of the closing sequences of, respectively, a switch without the anti-bounce device of the present invention, and a switch of the same general type but with the addition of the anti-bounce device disclosed hereinbelow.

DETAILED DESCRIPTION OF THE DRAWINGS

Figure 1:
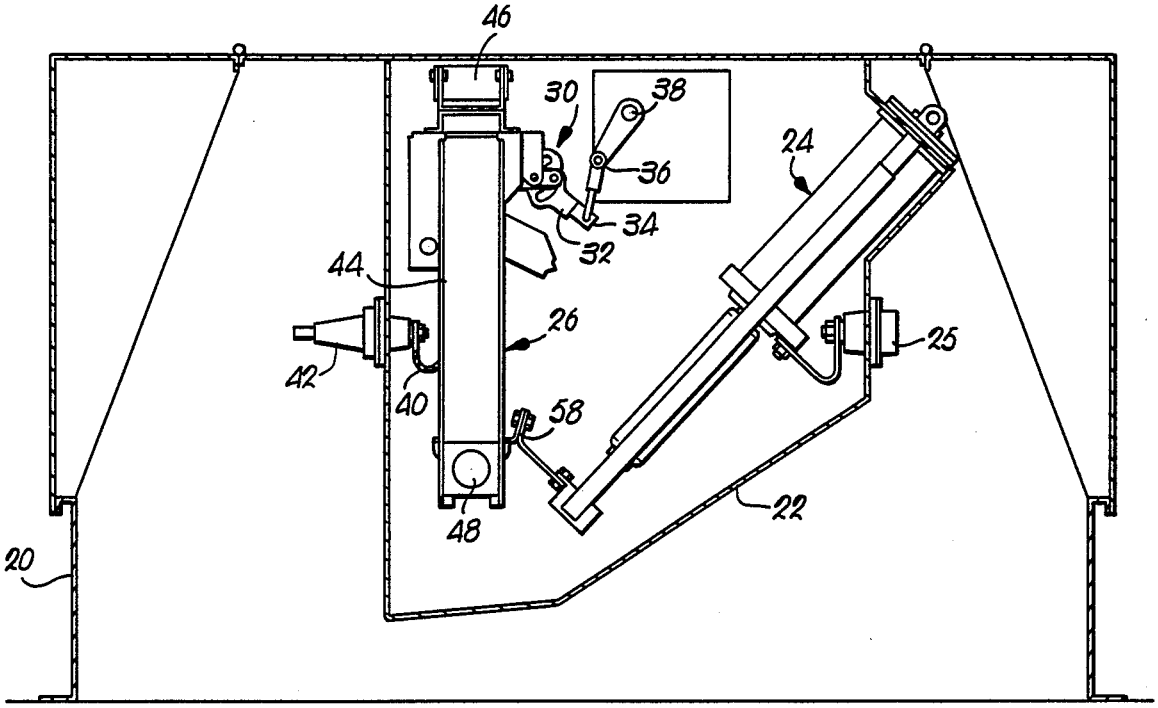
FIG. 1 is a side cross-sectional view of a pad mounted switch cabinet for underground distribution lines which cabinet includes a closing mechanism and an anti-bounce device of my present invention, the drawing further showing lead bushings, a fuse well and support structure for vacuum switch bottle assemblies for a three phase system.

Referring initially to FIG. 1, a pad mounted switching cabinet 20 is shown which includes an interior tank 22 which normally contains a quantity of fluid dielectric material such as oil. A fuse well 24 extends within tank 22 and is electrically coupled to a tap line bushing well 25 extending through the rear of the tank. A support structure 26 carries, for example, three vacuum bottle assemblies 28 (see FIG. 2) which are immersed within the oil and which are operatively coupled to switch opening and closing mechanism that is broadly designated 30 in FIGS. 1–8.

Viewing FIG. 1, switching mechanism 30 includes an operating handle 32 that is connected by bar 34 and linkages 36, 36 to a horizontally extending shaft 38 which may be rotated externally of the tank 22 for swinging the handle 32 in a vertical plane to open and close mechanism 30. Additionally, associated with each vacuum bottle 28 is a flexible lead 40 that is electrically coupled to a respective primary bushing 42 that extends through a front wall of the tank 22 for connection to a corresponding primary phase line.

As best illustrated in FIGS. 2–3 and 7–8, the support structure 26 within tank 22 includes two spaced, upright standards 44 that are secured to walls of the tank 22 by brackets 46, one of which is shown in FIG. 1. A cylindrical mounting rod 48 extends between a lower portion of the standards 44 and is preferably comprised of an electrically insulative, synthetic resinous material reinforced with glass fibers. Each vacuum bottle 28 is supported in upright disposition by a clamp 50 which saddles a top portion of mounting rod 48 and which is secured to the same by means of a U-shaped bolt and nut assembly 52.

Figure 8:
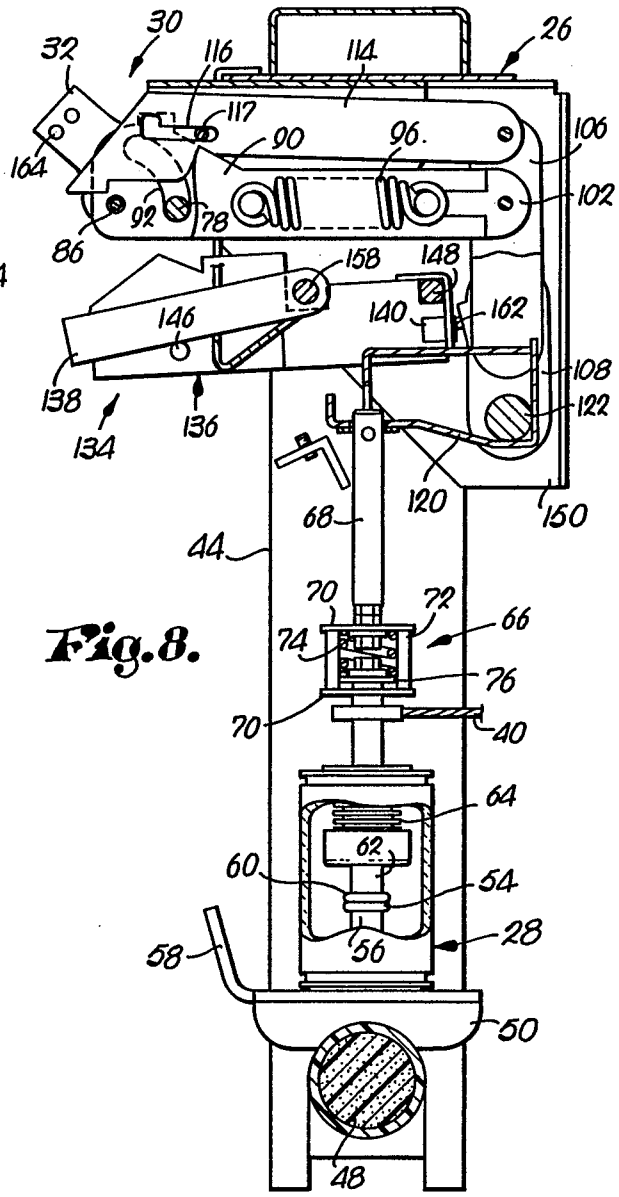
FIG. 8 is an enlarged, side cross-sectional view somewhat similar to FIG. 7 wherein components of the closing mechanism and the anti-bounce device are illustrated in positions assumed when the switch is closed and the energy oscillations have substantially subsided.
Figure 7:
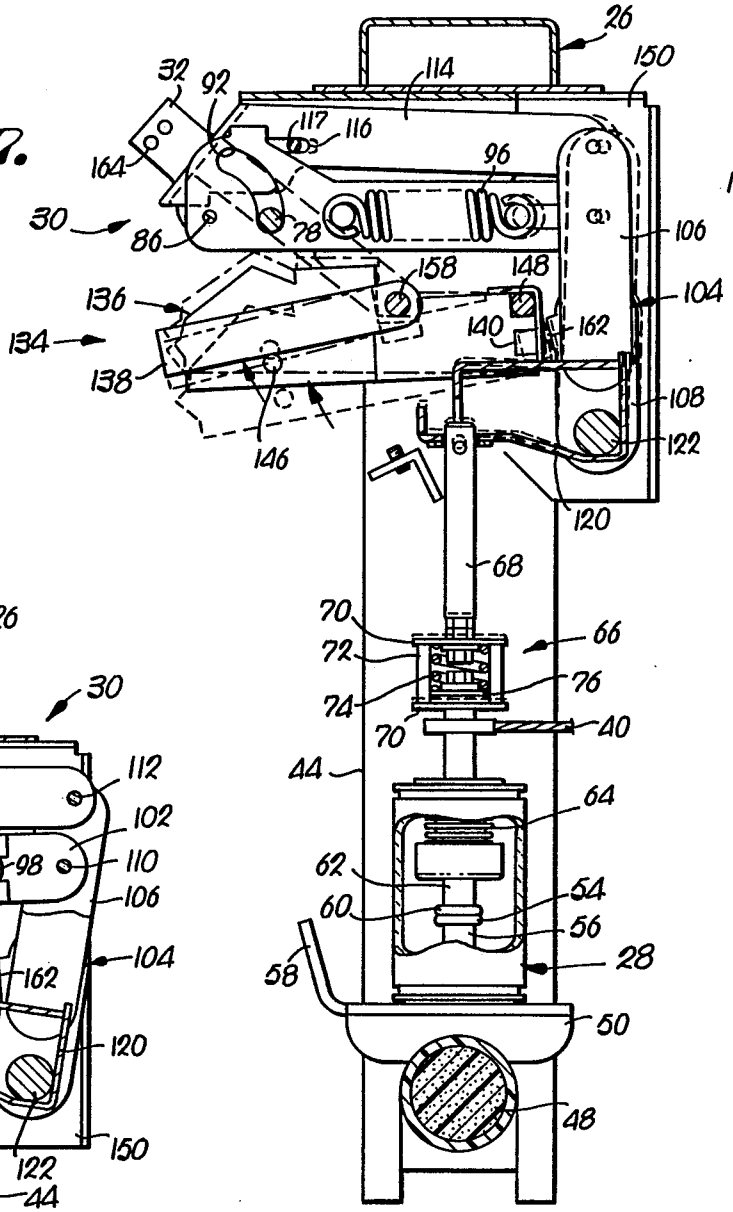
FIG. 7 is an enlarged side cross-sectional view somewhat similar to FIG. 3, wherein the operating handle has been shifted to unlatch the mechanism for closing the contacts and the dashed lines indicate an example of the path of travel of by the various components as kinetic energy from the closing springs is transferred from component to component.

Viewing FIGS. 3 and 7–8, each of the bottle assemblies 28 includes a lower stationary contact 54 that is fixed to an immovable copper shaft 56 that is, in turn, electrically coupled to a lead 58 that carries current to fuse well 24 (in this regard see FIG. 1). A second contact, designated 60, is mounted on a shiftable copper shaft 62 which extends through an opening in the top of vacuum bottle 28. Both of the contacts 54, 60 are comprised of a material such as tungsten, which is relatively harder than the copper shafts 56, 62.

A flexible metallic bellows 64 is secured to the shaft 62 and the top of bottle 28 for enabling movement of the shaft 62 without impairing the subatmospheric pressure conditions which exist within the interior of bottle 28. The bellows 64 are inherently resilient and urge the shaft 62 in a downwardly direction with a relatively light spring force. Additionally, the interior of the bellows 64 is exposed to the atmosphere; atmospheric pressure and the resiliency of bellows 64 combine to present a force of approximately twenty pounds for biasing shaft 62 toward stationary contact 54.

Viewing FIGS. 2–3 and 7–8, a contact wipe spring assembly 66 flexibly interconnects the electrically conductive shaft 62 and an overhead, upright insulating rod 68. The wipe spring assembly 66 includes a spring cage comprising two flat plates 70 held a fixed distance apart by three upright spacers 72. A coil spring 74 bounded by the spacers 72 bears against the upper plate 70 which is fixed to the lower end of insulating rod 68. A lower end of the spring 74 engages a washer 76 secured to an upper portion of shaft 62, and the latter extends through an oversized hole in the lower plate 70 so that shaft 62 and washer 76 can shift relative to the plates 70, 70 and the insulating rod 68 against the bias of spring 74.

Figure 2:
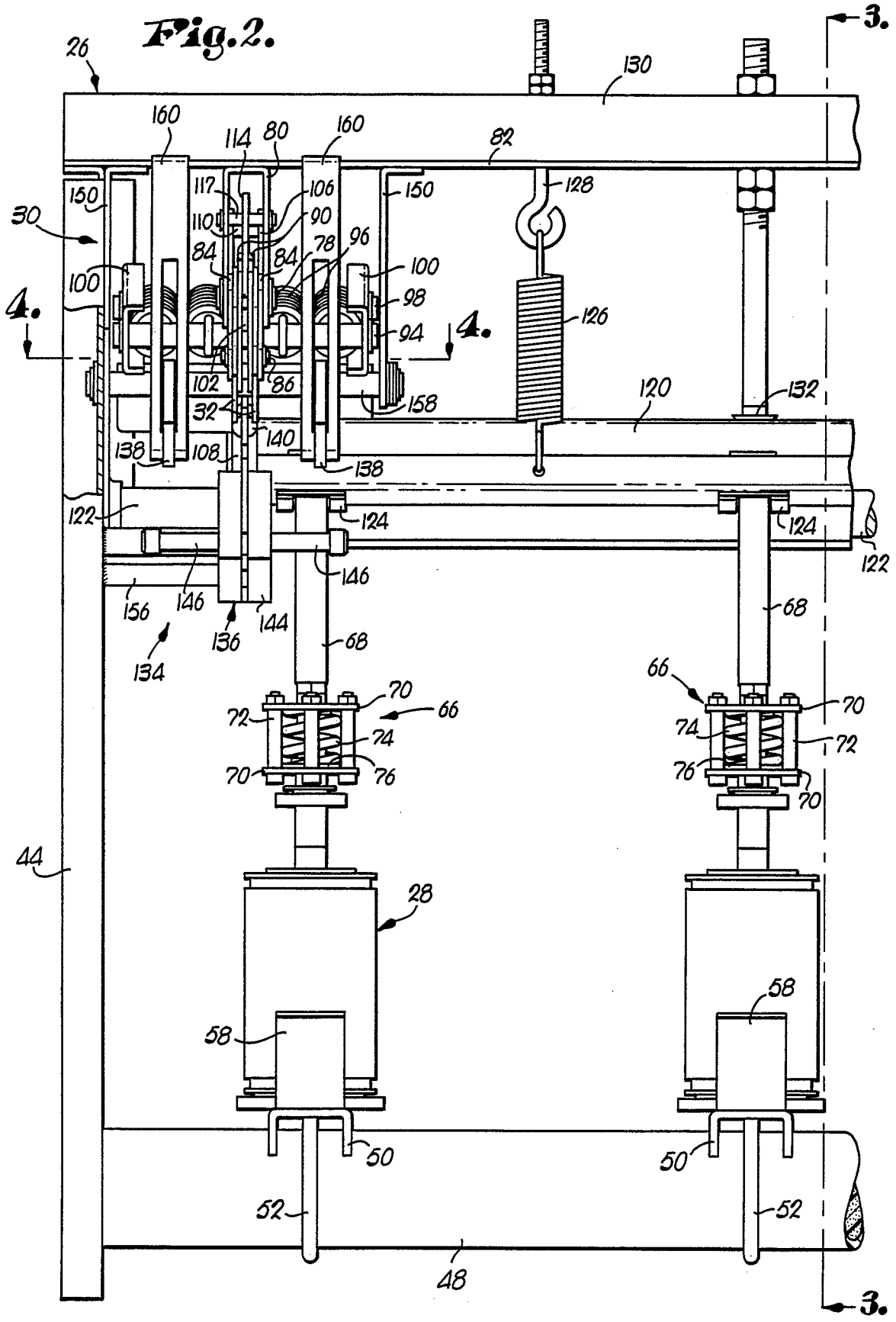
FIG. 2 is an enlarged, fragmentary, front elevational view of the closing mechanism, antibounce device and vacuum bottle assemblies of FIG. 1, further illustrating a horizontally extending operating beam for enabling the mechanism to simultaneously close or open the vacuum switch contacts, and also illustrating a wipe spring mechanism interposed between a contact shaft and an insulating rod, along with a horizontal moiunting rod which carries the vacuum bottle assemblies at a lower end portion thereof.

Attention is next directed to FIGS. 2–8 for a full understanding of switching mechanism 30. Operating handle 32 of mechanism 30 pivots about pin 78 which extends between two upright sides of a U-shaped, stationary bracket 80 that is secured to a plate 82 comprising part of the support structure 26 and extending between upper portions of standards 44. Two side-by-side, parallel, elongated small links 84 (FIGS. 2 and 3) are swingably carried by pin 78 and a pin 86 extends through both of the links 84, 84 at a position remote from pin 78. As shown in FIG. 2, each of the two upright operating handles 32, 32 are disposed within the space between links 84, 84 and have an arcuate slot 88 which freely receives pin 86 for movement therealong.

Two upright, elongated, parallel elements 90, 90 are located in the space between the operating handles 32, 32 and are pivotally mounted to pin 86. On the other hand, stationary pin 78 extends through an arcuate slot 92 in each of the elements 90, 90 to enable the latter to shift relative to bracket 80.

A horizontal spring shaft 94 extends through aligned holes in the elements 90, 90 and carries looped end portions of four side-by-side coiled closing springs 96. A second spring shaft 98 extends through opposite looped end portions of springs 96 (see FIGS. 6–8) and is received within a slotted end of each element 90, as perhaps shown best in FIGS. 6 and 8.

Figure 5:
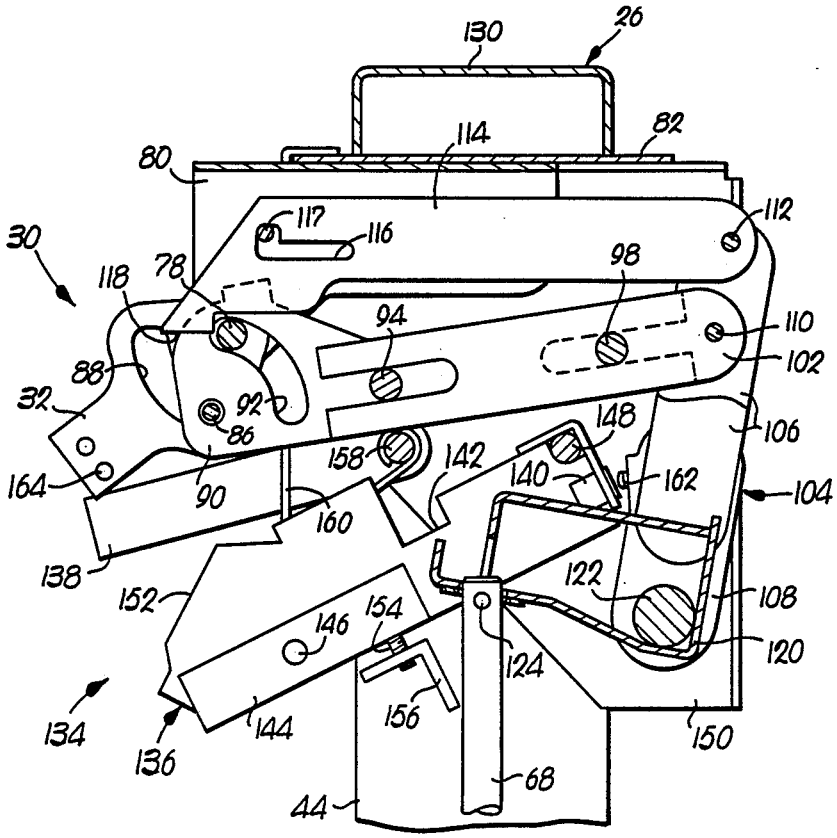
FIG. 5 is an enlarged, fragmentary, side cross-sectional view somewhat similar to FIG. 3 with parts removed to better illustrate certain components of the mechanism and anti-bounce device.

Referring to FIGS. 2 and 3, two parallel, spaced outrigger links 100 are pivotally coupled to opposite end segments of spring shaft 94. The U-shaped, upright outrigger links 100 each have a slotted end (see FIG. 3) remote from spring shaft 94 that slidably receives spring shaft 98. Finally, a middle link 102 is positioned in the space between elements 90, 90 as shown in FIG. 2 and receives spring shaft 98 as depicted in FIG. 5. Moreover, middle link 102 has a slotted end remote from spring shaft 98 that receives spring shaft 94 for movement therealong.

A lever assembly 104 comprises two upper, spaced levers 106, 106 and a central portion 108 that is fixed to lower portions of levers 106, 106 therebetween. As perhaps shown best in FIGS. 2–6, an end portion of middle link 102 remote from the slotted end of the same is disposed between middle regions of upright levers 106, 106 and receives a pin 110 that is connected to levers 106, 106. A pin 112 is connected to upper regions of levers 106, 106 and pivotally receives a latching member 114 that is most clearly shown in FIG. 5.

The latch member 114 is flat and somewhat aligned with the underlying, elongated elements 90, 90. Latch member 114 has an L-shaped slot 116, one leg of which is of a relatively long length and the other leg of which is substantially shorter, as viewed in FIGS. 5–8. A latch means or stop pin 117 is fixed to opposed walls of bracket 80 and is received in slot 116. Remote from the end portion of latching member 114 connected to pin 112 is an elongated, straight camming surface 118, the function of which will be understood upon further reading of this description.

Turning now to FIG. 2, a horizontally extending box beam 120 is fixed to a shaft 122 that is pivotally received on opposite ends to mounting structure on the opposed upright standards 44. Lever assembly 104, including levers 106 and central portion 108, are secured to both the shaft 122 and the beam 120 for swinging movement therewith. Spaced along the length of beam 120 are three pin couplings 124 which correspondingly are pivotally connected to the upright insulating rods 68 of respective body assemblies 28. As such, the lever assembly 104 in cooperation with box beam 120 functions as a rigid, L-shaped lever means having a first leg connected to rods 68 and a second leg connected to latching member 114 and middle link 102.

Two opening springs 126, one of which is shown in FIGS. 2 and 3, are connected to the beam 120 between adjacent pairs of bottle assemblies 28 and are coupled in upright disposition to an eyebolt 128 that is, in turn, fixed to an inverted, U-shaped channel 130 mounted atop the horizontally extending, upper plate 82. Overlying the middle vaccum bottle assembly 28, which represents a location approximately coinciding with the middle of beam 120, is an upright bolt or stop 132 that is secured in depending relationship to channel 130 and plate 82.

An anti-bounce device 134 functions as a means for reducing the velocity of all three movable contact shafts 62 and the respective contacts 60 supported thereby as the shafts 62 are moved by spring loaded switching mechanism 30 toward a closed circuit position, and also functions as a means for suppressing bounce of the contacts 54, 60 upon initial co-engagement of the same. The anti-bounce device 134 broadly includes a first swingable arm means or arm 136 and a second swingable arm means which comprises two parallel, second arms 138.

More particularly, the first arm 136 is elongated and includes a hardened insert 140 that extends through a L-shaped bar which is fixed in transverse relationship to the central portion of arm 136, as shown in FIGS. 4 and 5. The arm 136 has a U-shaped, upper slot presenting an engagement edge 142, and two elongated, weighted bodies 144 are fixed to a lower region of arm 136. As illustrated in FIG. 4, two horizontal rods 146 extend outwardly from the arm 136 and through a central region of the respective weighted body 144.

Arm 136 is connected to a pivot shaft 148 which is rotatably received on opposite ends in one of two upright plate supports 150, as shown in FIG. 4. One of the plate supports 150 is secured to one of the standards 44 and carries the shaft 122 which supports box beam 120. Viewing FIG. 2, each of the plate supports 150 are generally L-shaped and are fixed to the underside of upper plate 82.

The first arm 136 has an inclined weld break camming edge 152 remote from pivot shaft 148 as well as insert 140. Downward movement of the arm 136 about pivot shaft 148 is limited by an adjustable, threaded stop 154 that is supported by a horizontal angled member 156 which is fixed to one of the standards 44, as best shown in FIG. 2.

Each of the two second arms 138 is swingably mounted to a shaft 158 that is horizontally interconnected between the spaced, upright plate supports 150 (FIGS. 2 and 4). The second arms 138 are elongated and generally rectangular in cross-section and are relatively lightweight in comparison to the weight of the first arm 136.

Each of the arms 138 is received within an elongated, vertically oriented slot of a corresponding, generally C-shaped bracket 160. The upper leg of each bracket 160 is fixed to the top of plate 82, as shown in FIG. 3, and a lower leg of each bracket 160 presents a slotted, looped end portion which is partially wrapped about shaft 158 on each side of the corresponding second arm 138 (in this regard, see FIGS. 4 and 5). When the arms 138 are at rest and the switching mechanism 30 is in an open-circuit disposition, downward movement of the arms 138 is limited by a lower edge of the upright slot in the respective bracket 160, as is shown in FIG. 2.

OPERATION

The switching mechanism 30 for simultaneously opening and closing the contacts 54, 60 of each bottle assembly 28 is shown in its open circuit, at rest position in FIGS. 1–5. In the open circuit position, the lever means of mechanism 30, comprising the lever assembly 104 and box beam 120, are inclined in a clockwise direction viewing FIGS. 3 and 5 so that each of the insulating rods 68 is disposed in an upper position. Bias of the wipe spring 74 retains washer 76 against the lower plate 70, and rigid spacers 72 affixed to the plates 70, 70 prevent further extension of the spring 74 so that the movable contact 60 does not shift toward a position of engagement with stationary contact 54.

In the open circuit position of switching mechanism 30, upright opening springs 126 urge the box beam 120 of the lever means in a clockwise direction, viewing FIGS. 3 and 5, such that beam 120 rests against the lower end of stop 132 (FIGS. 2–3). In the open circuit disposition of mechanism 30, the four closing springs 96 are relatively free of substantial tension, and further the toggle stop pin 117 is positioned toward the left end of the short leg of slot 116 of latching member 114, as illustrated in FIG. 5.

Furthermore, when the switching mechanism is resting in its open circuit position, first arm 136 lies against stop 154 and both of the second arms 138 rest against the lower edge of the upright slots in respective brackets 160. Additionally, the hardened insert 140 mounted on first arm 136 is spaced from a hardened set screw 162 which extends outwardly from central portion 108 of lever assembly 104.

When the switching mechanism is to be operated to close contacts 54, 60, the horizontal shaft 38 (FIG. 1) is rotated by means of a socket wrench or the like to swing linkages 36, 36 and bar 34. As a result, the operating handles 32, 32 will pivot about main mechanism pin 78 (FIGS. 3 and 5), and the lower edge of curved slot 88 in each handle 32 contacts pin 86 to swing both of the small links 84, 84 simultaneously in an upward, clockwise direction about pin 78, until the handles 32 reach the positions that are depicted in FIG. 6.

Figure 6:
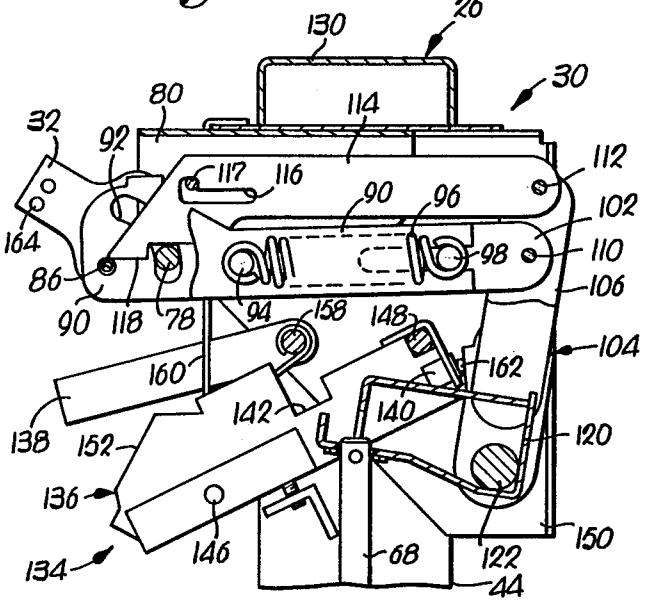
FIG. 6 is a fragmentary, enlarged, side cross-sectional view of the switch closing mechanism and anti-bounce device shown in FIGS. 1–5, wherein an operating handle has been shifted to stretch the springs of the mechanism immediately prior to moving the handle to a fully upward position for closing the switch.

The switching mechanism 30 in FIG. 6 is in an orientation ready to close the contacts 54, 60 although the latter are spaced in an open circuit position in FIG. 6 since box beam 120 and the vacuum bottle contact shafts 62 have moved only a small distance from their positions shown in FIGS. 2–5. In more detail, upward swinging of the operating handles 32, 32 to the position shown in FIG. 6 simultaneously swings the pin 86 to shift links 84, 84 and cause the elements 90, 90 to be moved somewhat upwardly and to the left viewing FIGS. 3 and 5–6. The elements 90, 90 move so that their respective slots 92, 92 shift relative to pin 78, consequently causing spring shaft 94 secured to the elements 90 to simultaneously move to the left and in an upward direction.

Shifting of the operating handles 32, 32 upwardly stretches all four of the switch closing springs 96 because spring shaft 94 is pulled to the left viewing FIG. 6 by elements 90 while the opposite spring shaft 98 is retained a fixed distance from levers 106, 106 by means of middle link 102. At the same time, lever assembly 104, and particularly levers 106, 106 are restrained from moving in a counterclockwise direction with reference to FIG. 6 due to the latch or stop pin 117 that is held in the relatively small leg of slot 116 of latching member 114, thereby preventing further movement of the latter to the left. Note, however, that some movement of the latching member 114 occurs when the handles 32 are raised to tension the springs 96 and the orientation of the slot 116 of latching member 114 shifts relative to the stop pin 117 from the position shown in FIG. 5 to the orientation depicted in FIG. 6.

As the handles 32 are moved from the orientation of FIG. 6 to the position shown in FIGS. 7–8, pin 86 engages camming surface 118 of latching member 114 while the handles 32 also cause the small links 84 to further swing about main pivot 78 and simultaneously shift both of the elements 90 in an upright direction along a path of travel defined by slot 92. As a consequence, movement of elements 90 shifts pin 86 upwardly against camming surface 118 and raises the latching member 114 so that stop pin 117 is now received in the relatively long leg of L-shaped slot 116 of member 114, as depicted in FIGS. 7–8. Once the member 114 is shifted so that the latch or stop pin 117 is disposed in the horizontal, elongated leg of slot 116, the latching member 114 quickly moves to the left viewing FIGS. 6–8 due to the bias of the four closing springs 96, which together provide a force of approximately 520 pounds when released from the fully stretched orientation shown in FIG. 6.

Release of the latching member 114 from stop pin 117 enables the lever assembly 104 to swing in a counterclockwise direction with pivotally mounted shaft 122. The closing springs 96 quickly swing the lever assembly 104 as spring shaft 98 moves to the left within the slotted righthand end of elements 90, as can be understood by comparing FIGS. 6 and 7–8.

Box beam 120, which is fixed to lever assembly 104, rotates with shaft 122 in a counterclockwise direction during closing of switching mechanism 30. As a consequence, beam 106 will move all three insulating rods 68 downwardly against the bias of wipe spring 74 and opening springs 126.

However, before engagement of movable contact 60 with stationary contact 54, the hardened set screw 162 of the lever assembly 104 impacts the first arm 136 to transfers a significant portion of the kinetic energy of the moving lever assembly 104 to the arm 136 and cause the latter to swing upwardly about pivot shaft 148. Thereafter, the velocity of lever assembly 104, and the insulating rods 68 moved therewith, is considerably reduced due to the transfer of energy from the lever assembly 104 to the first arm 136.

Immediately thereafter, and during upward swinging movement of the first arm 136, engagement surfaces on the two rods 146 of the first arm 136 contact the lower edge of respective second arms 138, as is depicted by the full line positions of the arms 136, 138 in FIG. 7. As a result, much of the momentum of the first arm 136 is transferred to the arms 138 and the latter swing upwardly about pivot shaft 158. The second arms 138 swing within slots of brackets 160 through a relatively large arc which can be appreciated by reference to the uppermost, dashed line position of the second arms 138 in FIG. 7.

Next, the remaining energy stored in first arm 136 causes the latter to continue to swing upwardly, although at a reduced speed, until the engagement edge 142 of the slotted upper portion of first arm 136 contacts the lower part of shaft 158, as depicted in the uppermost, dashed line position of the first arm 136 in FIG. 7. As a result of impact of the engagement edge 142 with pivot shaft 148, first arm 136 will rebound and travel in a counterclockwise direction until the hardened insert 140 carried by the first arm 136 again contacts the set screw 162 of lever assembly 104.

As the first arm 136 swings downwardly after rebounding against shaft 158, the lever assembly 104 continues to move to shift set screw 162 to the left and toward the insert 140. As a consequence, when the first arm 136 and the lever assembly 104 contact for a second time, a substantial portion of the remaining kinetic energy of the moving lever assembly 104 is dissipated and thus the velocity of the moving contact shafts 62 is reduced accordingly. However, since the first arm 136 has lost a great deal of kinetic energy by transference of the same to second arms 138 before impacting shaft 158, the impact of first arm 136 against shaft 158 occurs with substantially less force than would otherwise be possible so that the rebound of first arm 136 from the shaft 158 occurs with less energy and hence the velocity of the insert 140 toward the approaching set screw 162 is correspondingly reduced.

As the lever assembly 104 rotates to shift the three insulating rods 48 downwardly, the bias of the wipe spring 74 retains the washer 76 in seated engagement with the lower plate 70 until the contact shafts 62 are moved a sufficient distance to engage the movable contacts 60 with stationary contacts 54. After engagement of contacts 54, 60, the closing springs 96 continue to move the insulating rods 68 downwardly to urge the top plates 70 against the bias presented by wipe spring 74 and cause the washers 76 to lift from the bottom plates 70 a distance of approximately one-eighth inch, which is depicted in FIGS. 7 and 8 in full line. Once the mechanism 30 is closed, the small links 84 in cooperation with the elements 90 function as a toggle to prevent the bias of the wipe spring 74 to raise the insulating rods 68 and eliminate firm engagement between contact pairs 54, 60.

Comparison of the dashed lines with the solid lines for the various components shown in FIG. 7 provides an indication of the extent of movement during the same immediately subsequent to a closing operation, but during a period of time when the arms 136, 138 are rebounding and the components of the switching mechanism 30 are oscillating. In particular, it can be appreciated that the lever assembly 104, the box beam 120, the wipe spring assembly 66, the latching member 114 and the closing springs 96 continue to oscillate due to the spring loaded, snap action of the mechanism 30 once the latter is closed. However, it has been found that provision of the second arms 138, 138 in cooperation with the first arm 136 permits sufficient kinetic energy to be stored in the arms 136, 138 immediately after the closing operation, without adversely combining with resultant oscillations of the lever assembly 104, the box beam 120 and the wipe spring assembly 66 which could otherwise in some instances combine to form a resultant oscillation sufficient to overcome the toggle of mechanism 30 and snap the movable contacts 60 to an opened position.

Referring now to the velocity-time characterizing graphs of FIG. 9, the uppermost velocity and voltage graph is indicative of resultant values observed when a switching mechanism of a type similar to the mechanism 30 is utilized without provision of energy absorbing arms corresponding to arms 136, 138 of the present invention. As can be seen, the velocity graph, which represents the velocity of a movable contact shaft, rapidly increases from a value of zero when the shaft is at rest to a value of eight or nine feet per second when a movable contact first engages a stationary contact. As shown, oscillations caused by a result of contact bounce are sufficient to open the contacts for short periods of time, as indicated by the voltage graph taken across the contacts. In some instances, and as illustrated, oscillations continue to occur a relatively long length of time (approximately 25 to 30 milliseconds) from initial closing of the switch with, in some instances, sufficient amplitude to reopen the contacts, a problem which is serious when the switch is closed into a fault.

By comparison, the graphs depicted in the lower regions of FIG. 9 represent resultant values observed by utilization of the energy absorbing arms 136, 138 of the present invention. Initially, contact shaft 62 accelerates from a position at rest to a speed of approximately four feet per second, and at this time the set screw 160 impacts against hardened insert 140 such that a portion of the kinetic energy of the lever assembly 104 is transferred to the first arm 136. As shown, the velocity of the contact shaft 62 remains approximately steady thereafter until the first arm 136 returns to again engage the set screw 160, causing the contact shaft 62 to be decelerated steadily until the movable contact 60 engages stationary contact 54, at which time the velocity of the contact shaft 62 and the contact 60 is approximately one foot per second. However, it is to be appeciated that without provision of the second arms 138, 138 the rebounding, second impact of the first arm 136 against the set screw 160 would occur with such force that proper closing of the contacts 54, 60 would not be possible.

Provision of the second arms 138, 138 in effect "buy time" by storage of kinetic energy in a swinging motion of the arms 138, 138 which do not return to reengage the first arm 136 until a significant quantity of time has elapsed and oscillations in other components of the system have subsided. The first arm 136, on the hand, is disposed beneath the major portion of switching mechanism 30, and therefore only a somewhat small arc is available for swinging movement of arm 136. Without provision of second arms 138, 138, first arm 136 would rebound against shaft 158 with such a force that the arm 136 would thereafter engage set screw 162 with a considerable velocity.

As is known, the laws of physics state that force is equal to mass times acceleration, and therefore reduction in the acceleration of contact shaft 62 will reduce the impact force of the contacts 54, 60 for suppression of bounce. On the other hand, it is a difficult proposition to reduce the mass of the components without adversely effecting the positive, snap action of the closing mechanism 30 to insure that contacts 54, 60 are properly seated with sufficient force.

FIG. 8 illustrates the position of the various components of the present invention once oscillations have subsided after closing of the contacts 54, 60. In the closed position, set screw 162 abuts insert 140, and second arms 138, 138 rest on rods 146. The latching member 114 is positioned such that the stop pin 117 is disposed toward an end region of the elongated, longer leg of slot 116, and the washer 76 is spaced from the lower plate 70 whereby the wipe spring 74 exerts a biasing force to urge contact 60 toward contact 54. However, over center toggle of small links 84, 84, in cooperation with elements 90, 90 prevents the springs 74 from shifting the mechanism 30 to a position wherein free play is available for eliminating the relatively large force of springs 74 from urging contacts 60 against contacts 54, a force which is preferably 120 pounds for each bottle assembly 28.

To return the mechanism 30 from a closed position to an opened position, the operating handles 32 are shifted downwardly about pivot pin 78 until the top edge of slot 88 engages pin 86. Next, continued movement of the handles 32 in a downward direction shifts small links 84 to an over center position relative to pin 78, thereby releasing the toggle to enable the three wipe springs 74 to shift the insulating rods 68 upwardly approximately one-eighth inch until spring 74 is fully extended and washer 76 contacts lower plate 70. Thereafter, the two opening springs 126 lift the box beam 120 upwardly to return the mechanism 30 to the orientation shown in FIGS. 2–5.

If, for some reason, the contacts 54, 60 are welded shut, as may occur after extended periods of use in a closed circuit position, opening springs 126 may be insufficient for separating the contacts 54, 60. In such a case, continued downward movement of the handles 32, 32 toward the first arm 136 will cause a pin 164 which extends through a lower side of both handles 32, 32 to engage camming edge 152 on first arm 136. In this regard, when the contacts 54, 60 are welded together, and the handles 32, 32 are shifted downwardly to the position shown in FIGS. 3 and 5, the first arm 36 will nevertheless be retained in a position that is slightly above its position depicted in FIG. 8, since the lever assembly 104 and the set screw 162 carried thereby are prevented from further movement in a clockwise direction (viewing FIG. 8) when the contacts 54, 60 are welded.

Handles 32, 32 are moved downwardly to shift pin 164 along camming edge 152. The first arm 136 functions as a weld-break lever due to the relatively long length between pivot shaft 148 and the camming edge 15, and the relatively short length between the pivot shaft 148 and the hardened insert 140. Thus, further downward movement of the handles 32, 32 will cause the lever assembly 104 to rotate in a clockwise direction and break the weld between contacts 54, 60.

I claim:

1. In an electrical switch having a pair of electrical contacts, a shaft supporting one of said contacts for movement with the latter between an open circuit position wherein said contacts are spaced from each other and a closed circuit position wherein said contacts are in direct engagement with each other, and a spring loaded mechanism for moving said shaft toward said closed position, means for reducing the velocity of said shaft and said contact supported thereby as said shaft is moved by said spring loaded mechanism toward said closed circuit position and for suppressing bounce of said contacts after an initial engagement of the same comprising:

first elongated arm means presenting an impact surface;

pivot means mounting said first arm means to initially locate said impact surface in the path of said spring loaded mechanism as said mechanism moves said shaft toward said closed circuit position and for enabling swinging movement of said first arm means after initial contact of said impact surface with said mechanism in a direction initially away from the mechanism and subsequently back toward said mechanism to again contact the latter, said initial contact of said impact surface with said mechanism causing said first arm means to absorb a portion of the kinetic energy of said mechanism and to thereby reduce the velocity of said shaft moved by said mechanism as said shaft shifts toward said closed circuit position;

second elongated arm means having an engagement surface; and pivot means mounting said second arm means for free swinging movement toward and away from said first arm means during movement of said first arm means, said pivot means mounting said second arm means being located to at least initially position said engagement surface of said second arm means in the path of swinging movement of said first arm means subsequent to initial impact of the latter by said mechanism, to cause said second arm means to absorb a portion of the kinetic energy of said first arm means that would otherwise be transferred from said first arm means back to said mechanism during subsequent rebounding contact therewith as said first arm means swings back toward said mechanism, and to thereby substantially reduce the kinetic energy transferred from said first arm means to said shaft in directions along the latter away from said closed circuit position so that the tendency of said contacts to separate by rebounding impact of said first arm means with said mechanism after said initial impact is.

2. The invention of claim 1, wherein said mechanism includes a pivotal operating handle, and wherein said handle is engageable with said first arm for prying of said lever means in a direction such that said shaft is urged away from said closed circuit position and for generally breaking any weld between the contacts that may have occured.

3. The invention of claim 1, wherein the mass of said second arm is less than the mass of said first arm and said swinging movement of said second arm occurs over a greater arc than the arc of swinging movement of said first arm for lengthening the period of time between said initial engagement of said second arm with said first arm and subsequent engagements thereof.

4. The invention of claim 1, wherein said first arm and said second arm are swingable in substantially vertical planes of reference.

5. The invention of claim 1, including wipe spring means interposed between said mechanism and shaft for providing tolerance of the shaft position when the latter is in said closed circuit position, and for enabling said mechanism to be utilized in operational conjunction with the contact supporting shafts associated with additional contact pairs.

6. A high voltage switch comprising:

a pair of electrical contacts;

a shaft supporting one of the contacts for movement with the latter between an open circuit position wherein said contacts are spaced from each other and a closed circuit position wherein said contacts are in direct engagement with each other;

support structure;

lever means pivotally carried by said support structure and presenting a first leg connected to said shaft and a second leg extending outwardly at an angle from said first leg;

an operating handle pivotally connected to said support structure;

an element shiftably coupled to said support structure and movable in response to pivotal movement of said handle;

spring means interconnecting said second leg of said lever means and said element for yieldably biasing said second leg toward said element;

a latching member pivotally connected to said second leg of said lever means and shiftably coupled to said support structure;

fixed latch means engageable with said member for retaining said lever means in a location wherein said shaft is in said open circuit position and for generally precluding movement of said lever means which would otherwise occur due to the bias presented by said spring means; and means associated with said swingable element for selectively releasing said latch means to enable the bias of said spring means to shift said lever means for movement of said shaft connected thereto toward said closed circuit position.

7. The invention of claim 6, wherein said latching member has a slot means receiving said latch means, and at least a portion of said slot means has an L-shaped configuration including an elongated portion extending in generally parallel relationship to said spring means.

8. The invention of claim 7, wherein said latch means comprises a pin secured to said support structure.

9. The invention of claim 8; including an energy-absorbing, swingable arm-disposed in the path of travel of said lever means as the latter is shifted toward said closed circuit position.

10. The invention of claim 6, wherein said means associated with said swingable element for selectively releasing said latch means comprises pin means engageable with said latching means for shifting the latter during movement of said element.

* * * * *